US005525962A

United States Patent [19]

Tice

[11] Patent Number: 5,525,962

[45] Date of Patent: Jun. 11, 1996

[54] COMMUNICATION SYSTEM AND METHOD

[75] Inventor: Lee D. Tice, Barrington, Ill.

[73] Assignee: Pittway Corporation, Chicago, Ill.

[21] Appl. No.: 264,631

[22] Filed: Jun. 23, 1994

[51] Int. Cl.[6] ..... G08B 29/00

[52] U.S. Cl. ..... 340/506; 340/505; 340/512; 340/513; 340/825.06

[58] Field of Search ..... 340/506, 505, 340/512, 513, 310.06, 825.06, 825.09, 825.1, 825.11, 825.12; 11/11; 364/138, 140, 141; 375/22, 36, 37; 370/9

[56] References Cited

U.S. PATENT DOCUMENTS

| | | | |
|---|---|---|---|
| 4,463,352 | 7/1984 | Forbes et al. | 340/505 |
| 4,506,254 | 3/1985 | Right et al. | 340/513 |
| 4,507,652 | 3/1985 | Vogt et al. | 340/505 |
| 4,667,193 | 5/1987 | Cotie et al. | 340/825.06 |
| 4,916,432 | 4/1990 | Tice et al. | 340/518 |
| 4,926,158 | 5/1990 | Zeigler | 340/505 |

OTHER PUBLICATIONS

Telecommunication Transmission Handbook, Roger L. Freeman, Third Edition, pp. 737–738 May 1992.

*Primary Examiner*—Donnie L. Crosland

*Attorney, Agent, or Firm*—Dressler, Goldsmith, Shore & Milnamow, Ltd.

[57] ABSTRACT

A communication system includes a control element, a bidirectional communications link, and one or more devices coupled to the link. The control element, via driver circuits, reversibly applies a predetermined potential to the link for the purpose of energizing the one or more devices as well as communicating therewith. The devices can respond at appropriate time intervals. During the responding time intervals, the control element can continue to supply power to the devices.

19 Claims, 4 Drawing Sheets

COMMUNICATION SYSTEM AND METHOD

FIELD OF THE INVENTION

The invention pertains to systems and methods for communicating with a plurality of devices displaced from a common control unit. More particularly, the invention pertains to communication system which incorporate common communications links used by the displaced devices for communicating with the common control unit.

BACKGROUND OF THE INVENTION

Monitoring systems for detecting potential fire conditions in commercial or industrial buildings are often distributed throughout the various floors or areas of the respective building. Detector or control units are placed at locations on various floors or in devices where it is desirable to be able to determine, as early as possible, whether or not there is a potential fire condition.

The detectors or control devices are conventionally linked by one or more sets of communications lines to a common control panel. This control panel receives information from the spaced apart detectors or control devices and is often equipped to make a determination as to whether or not one or more of the detectors is reporting a potential fire condition.

One form of communication system and method are disclosed in Tice et al. U.S. Pat. No. 4,916,432 entitled "Smoke and Fire Detection System Communication" assigned to the assignee of the present invention. Systems of the type of the noted Tice et al. patent provide discrete time intervals during which electrical energy can be supplied to the remote units via the communication links and the common control panel. Using the communication link to also power the displaced detectors, control devices, as well as other units in the system, minimizes the number of lines which need to be installed to service the displaced units.

In known communication systems, the length of time available to provide electrical energy to the displaced units can become a significant issue. As the number of detectors or other units increases, the amount of electrical energy which needs to be supplied through the communications link also increases.

The communication links, which may be several thousand feet long, are often implemented with relatively small diameter wire, for example, 18 gauge. The length and size of the wire limit the amount of electrical energy which can be supplied in a given time interval. Further, as the number of detectors or control units increases, the length of the communication lines may also increase. This results in additional losses which may make it impossible to adequately power the detectors or other units which are located furthest away from the common control element.

Additional difficulties which can be experienced as the number of detectors on a communication loop is increased, can include electrical noise which interferes with an ability to properly detect information being transmitted to or being received from detectors or control units.

There thus continues to be an unmet need for communication systems which can provide sufficient quantities of energy to support larger numbers of detectors than has heretofore been possible. In addition, it would be desirable to be able to increase the noise immunity of such systems notwithstanding the fact that even longer wire lengths and larger numbers of detectors need to be installed to meet the needs of current building requirements.

Preferably, providing for increased energy levels as well as increased noise immunity can be achieved without substantially increasing either the cost of such systems or the complexity thereof. It would also be desirable to be able to provide for larger peak to peak voltages of information from distributed units to the common control element so as to provide increased noise immunity and reliability in such systems.

SUMMARY OF THE INVENTION

A communication system in accordance with the present invention is usable with a plurality of spaced apart devices which could include detector or control units. The system includes a control element and a bidirectional communications link.

The link is couplable to one or more of the devices. The control element includes balanced or double ended driver circuitry for reversibly applying a selected electrical potential across the link to provide a potential change on the order of twice the value of the applied potential.

The control element includes circuitry for modulating the electrical potential with an information sequence. The modulating circuitry can use a pulse duration modular scheme. Other types of modulation, such as frequency modulation, can also be used.

One or more of the displaced devices can include receiver circuitry for detecting the modulated, reversibly applied electrical potential. The devices can each include a full wave rectifier to provide a local source continuously energized by the modulated waveform.

The displaced devices can include ambient condition detectors such as smoke, temperature or gas detectors. Alternately, intrusion detectors, such as PIR, ultrasonic or infrared beam detectors could be used. The present communication system can also be used with manually operable switches, and key pad or card reader based entry control systems. In addition, environmental control devices such as heating, circulation, cooling or illumination equipment can be coupled to and controlled using communications systems in accordance with the present invention.

A method of bidirectional communication between a control element and one or more displaced devices includes the step of providing a source having a predetermined electrical potential. The source is reversibly applied to generate a modulated pulse sequence with an amplitude on the order of twice the predetermined potential.

The modulated pulse sequence is transmitted to the displaced devices. The pulse sequence can be pulse width modulated. Electrical energy can be supplied via the modulated pulse sequence to power the devices. The modulated pulse sequence can be detected in at least one of the devices.

DETAILED DESCRIPTION OF THE PREFERRED EMBODIMENT

Figure 1:
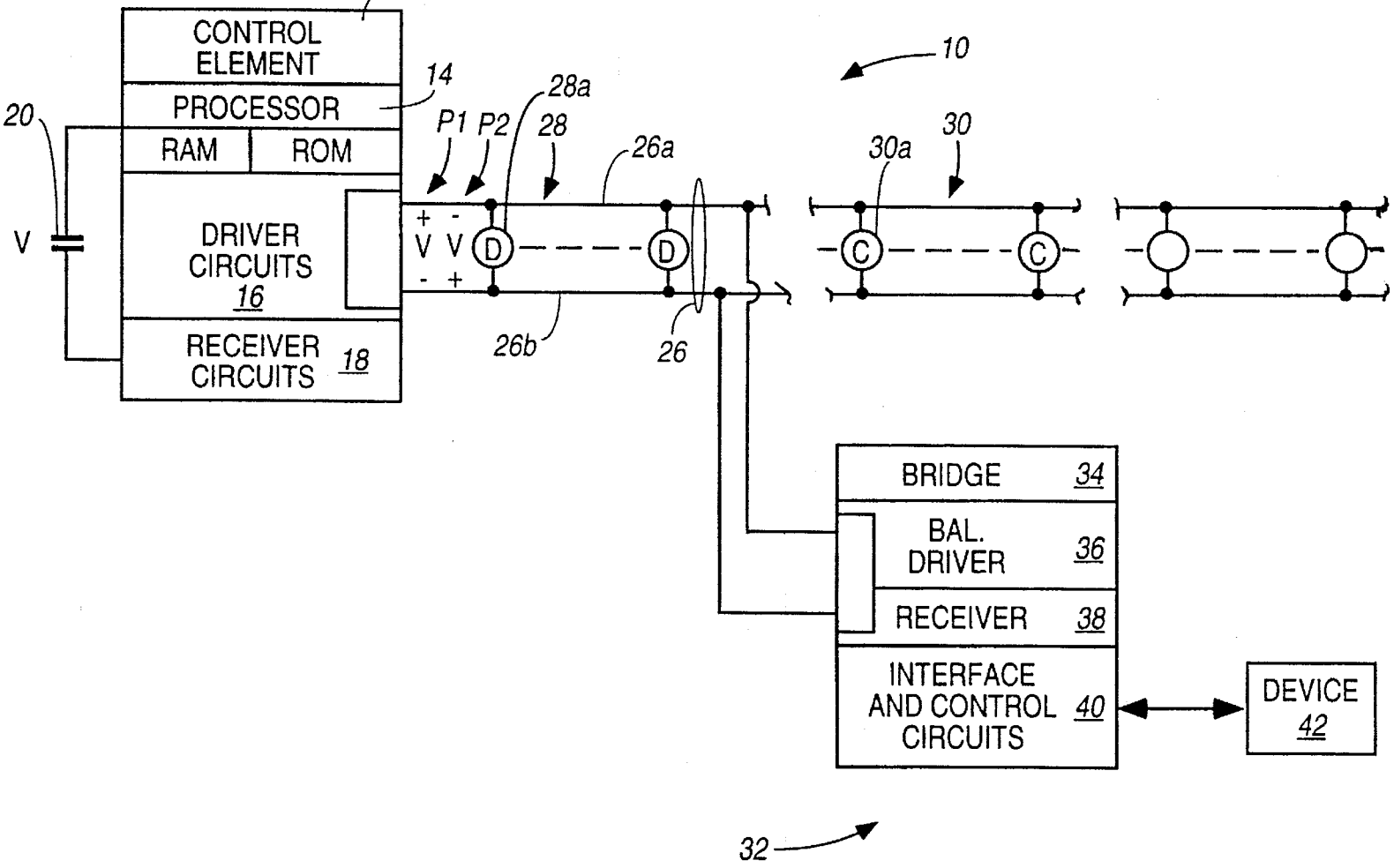
FIG. 1 is a block diagram of a system in accordance with the present invention.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 is a block diagram of a system 10 in accordance with the present invention. The system 10 includes a common control element or panel 12. The element or panel 12 can be implemented in part by a programmed processor 14. The processor 14 could be a microprocessor with associated Read Only Memory (ROM) and Random Access Memory (RAM).

The element 12 includes for output purposes balanced driver circuitry 16 and receiver circuitry 18. The element 12 is powered from a power supply of a conventional type, indicated symbolically as a battery 20 with an output potential "V".

The element 12 is coupled to a bi-directional communications link 26 via the driver circuit 16 and receiver circuits 18. The communications link 26 can include a plurality of elongated electrical conductors. The size, type and number of the members of the link 26, are not a limitation of the present invention.

Coupled to the link 26 is a plurality of detector elements 28 and a plurality of control elements 30. The members of the plurality 28, such as a detector 28*a*, could be implemented as smoke detectors, gas detectors, temperature detectors, intrusion detectors or the like.

The members of the plurality 30, such as a control element 30*a*, provide interfaces to input or output devices. Input devices can include pull switches or access control units. Output devices can include electrically operated door locks or electrically controllable fire doors, lighting or environmental control devices. It will also be understood that the members of the plurality 28 or 30 can include other types of detectors or control devices without limitation.

Common details of the members of the pluralities 28 and 30 are illustrated in a representative device 32. The device 32 is coupled to the communication link 26 and includes a full-wave rectifying bridge 34, receiver circuitry 36 and balanced driver circuitry 38. The unit 32 also includes appropriate detector or control circuitry interface 40.

The circuitry 40 can interface to/from a detector or a controllable device 42. Device 42 can include condition or event detectors such as ionization or photoelectric type smoke detectors or door or window condition sensors respectively.

Communications between the control element 12 and members of the pluralities 28 and 30 are carried out on the bi-directional link 26 using the balanced driver circuits 16 and 36 respectively. The driver circuit 16 generates and applies a modulated switching voltage to the link 26 for communications originating at the control element 12.

The modulated switching wave has a peak-to-peak amplitude on the order of 2 V volts. 2 V volts could, for example, correspond to 24 volts. A first amplitude +V with a first polarity P1 is produced during an initial time interval and the same amplitude. The same amplitude, V, but with a reverse polarity P2 is produced during a second time interval.

As a result of driving the communication link 26 using balanced driver circuit 16, the peak to peak switching voltage applied across the illustrated members 26*a* and 26*b* of the link 26 has an amplitude on the order of 2 V volts.

The waveform generated by the driver circuits 16 is a symmetrical digital waveform. Communications received from the members of the pluralities 28 and 30 can also be in the form of a symmetrical digital waveform. Alternately, analog signalling can be used by one or more of the members of the pluralities 28 and 30.

Advantages of the system 10 include the use of zero crossing edge detection circuitry in the members of the pluralities 28 and 30. This circuitry provides a relatively high level of noise immunity. In addition, the balanced driving protocol makes it possible to deliver higher levels of power, continuously, to the pluralities 28 and 30, and also makes it possible to use relatively high resistance telephone wire for the links 26*a* and 26*b*.

The amplitude of voltage transmission from the members of the pluralities 28 and 30 provides an indication of line voltage and line impedance to the control element 12. In addition, the use of balanced drive circuits, such as driver 36, provides enhanced noise immunity for transmissions to the control element 12.

The balanced driving protocol can be used with a plurality modulation schemes such as pulse width modulation or frequency modulation for example. It will be understood that the type of modulation is not a limitation of the present invention.

Figure 2:
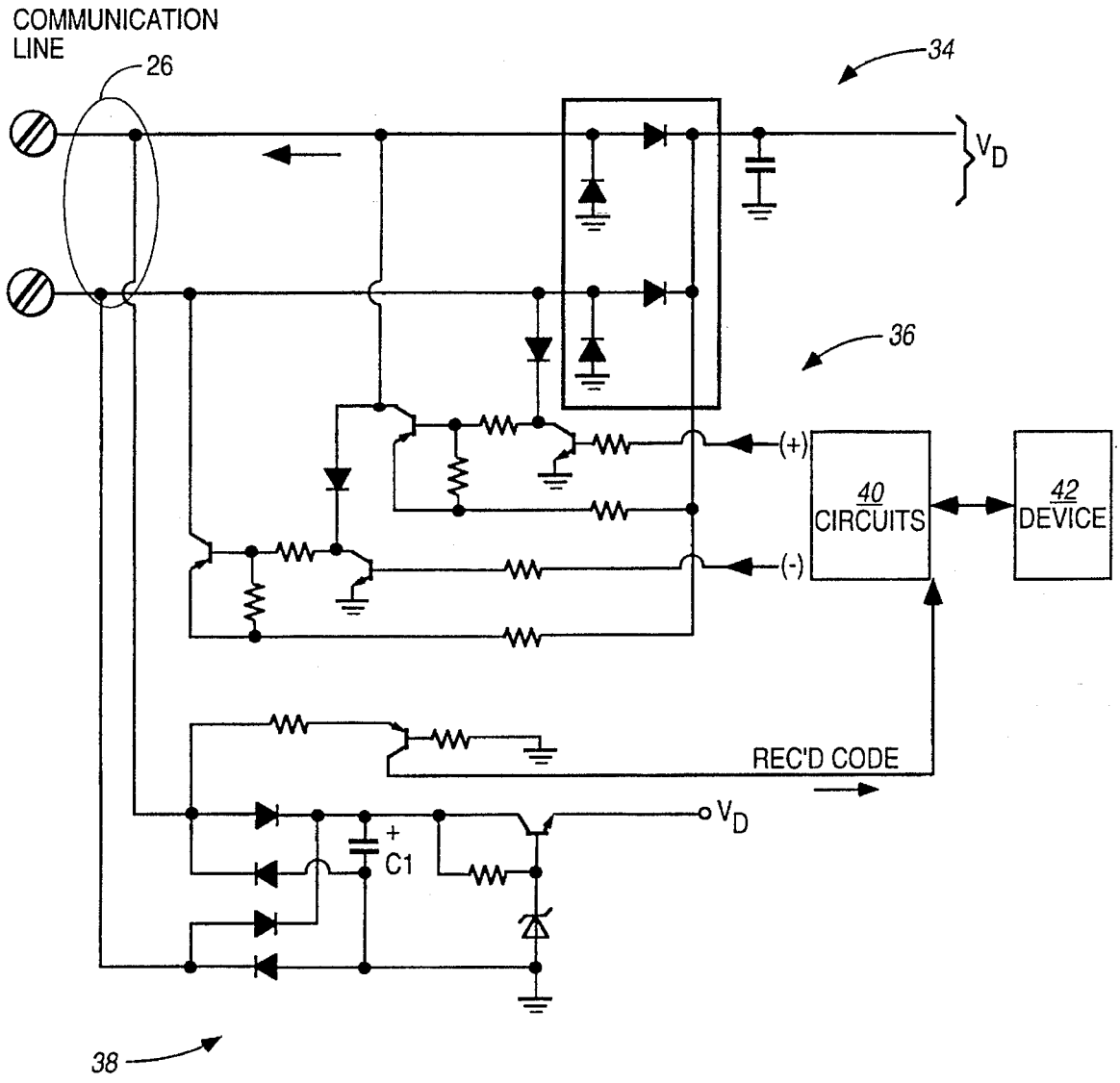
FIG. 2 is a schematic diagram of a device usable with the present system.

FIG. 2 is a schematic diagram of a portion of the unit 32. In FIG. 2 the full-wave bridge 34 is illustrated coupled to the communication link 26. A local DC voltage $V_D$ can be produced to energize the unit 32. The balanced driver circuitry 36 is illustrated coupled to the detector/control interface circuitry 40. Additionally, FIG. 2 illustrates receiver circuitry 38 coupled to the detector/control circuitry 40.

The balanced driver circuitry 16 used in the control element 12 can be the same as the driver circuitry 36 illustrated in FIG. 2.

Figure 3:
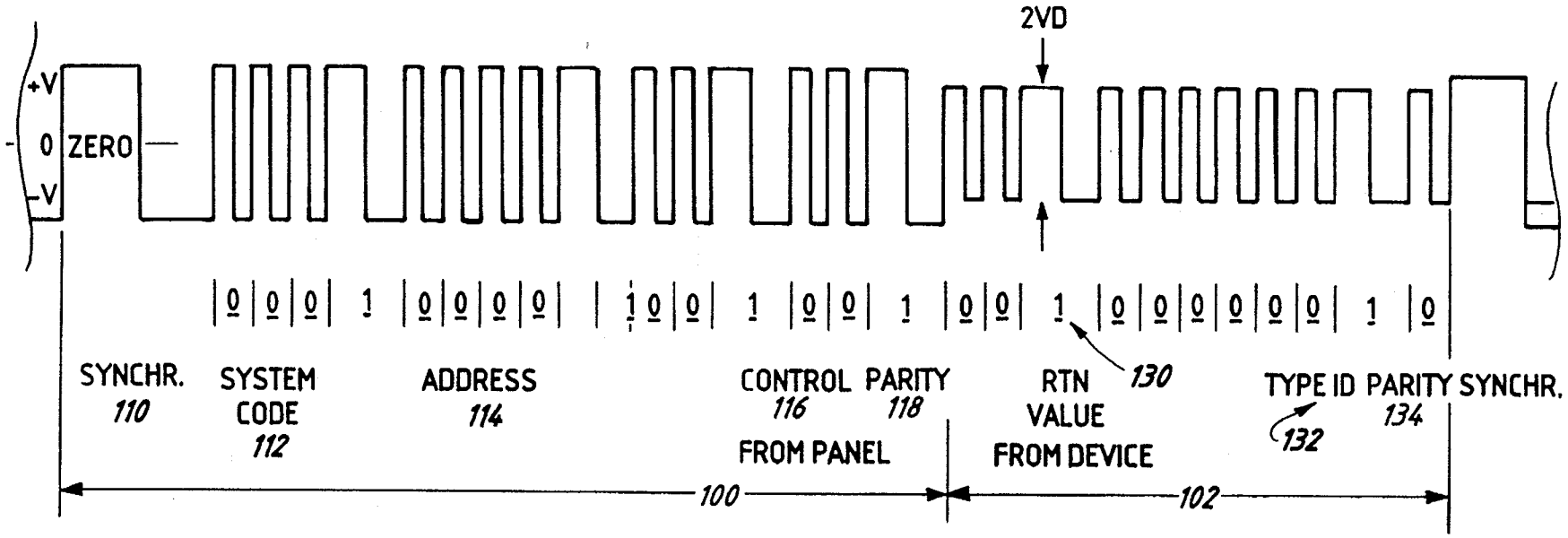
FIG. 3 is a timing diagram further illustrating characteristics of the present communication system.

FIG. 3 illustrates an exemplary communication sequence which includes a message 100 being sent by the control element 12 to one or more members of the pluralities 28 and 30 and a response 102 thereto from an addressed device, such as the device 32. The first portion 100 of the communication is a balanced transmission with peak-to-peak amplitude on the order of 2 V from the control element 12 to the devices coupled to the link 26. The second portion 102 illustrates a response from a device, such as the device 32. The peak-to-peak value on the order of 2 $V_D$.

The region 100 includes a symmetrical synchronization pulse 110 which has a relatively long period for purposes of allowing all of the units in the pluralities 28 and 30 to synchronize themselves with the remainder of the message sequence 100. Subsequent to the symmetrical synchronization pulse 110, a pulse-width modulated digital sequence is transmitted.

The digital sequence includes a system identification code 112, a device address code 114, and a control code 116 which provides a command or other control information to the unit corresponding to the address 114. Subsequent to the control bits 116 a parity bit 118 can be provided.

The elements of the message 100 are all transmitted, in the exemplary embodiment of FIG. 3, as symmetrical, pulse-width modulated signals. For purposes of explanation, the transmitted address 114 corresponds to the binary bit pattern 10000100. The control sequence 116 corresponds to a bit pattern of 100. The parity bit 118 is transmitted as a 1.

The unit corresponding to the address 114 is then able to communicate with the control element 12 during the unit response time interval 102. The unit response can take the form of a balanced digital transmission to the control element 12.

The returned signal has an amplitude of about 2 $V_D$. Sensing this value at the control element 12 provides an indication of the line voltage being delivered to the replying device. If this value falls below a predetermined threshold, there is excessive line loading which needs to be eliminated. Alternately, the unit transmission to the control element 12 can include both digital and analog representations of information.

As is illustrated in FIG. 3, the device response can include a digital sequence 130. This sequence can be representative of a parameter value or any other indicium returned from the addressed device. If the addressed device is a condition sensor, the returned value is indicative of the sensed condition corresponding to a bit pattern of 0010000.

During the time period when replying units are communicating to the control unit, the replying units are alternately driving the line positive and negative using their internal power capacities. Alternately, the replying unit could drive the line in only one polarity, either positive or negative.

The addressed unit can also identify itself by providing a digital representation of a type code in an interval 132 followed by a parity bit 134.

During communication from the control element 12, the device driver can be shut off. During communication from the device, 1) the control element driver can be shut off so the line is floating (high impedance) and balanced; and 2) all device visual outputs, LED drivers can be shut off.

All detection measurements are made on positive transitions and compared to the "zero" volt reference (middle of waveform). An important aspect of this invention is that the high time and low time of each bit is the same (symmetrical). Thus distortion due to capacitance and resistance (RC) will be compensated out at the "zero" crossings and not affect the data time measurement. Such distortions will only result in a phase delay of data.

Figure 4:
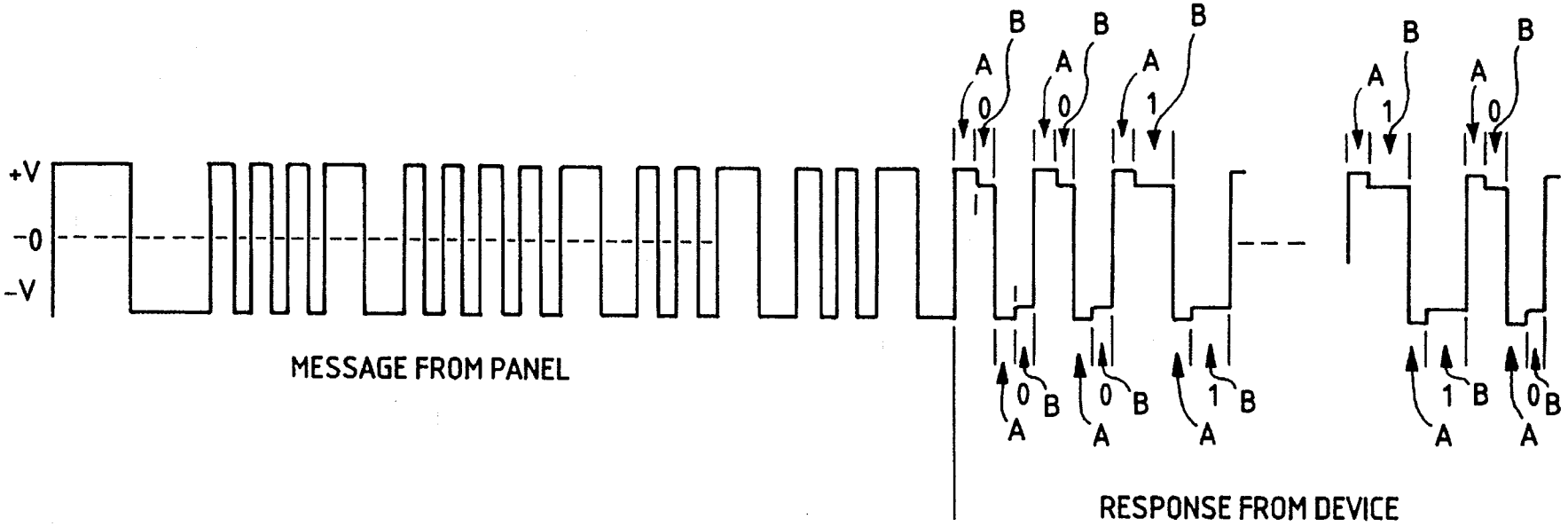
FIG. 4 is a timing diagram illustrating another aspect of the communication system.

Alternately, as shown in FIG. 4, if desired, the control unit 12 can continue to supply power to the devices 28, 30 during the periods when the devices are communicating back to the control unit. The control unit 12 will sense when the replying unit has driven the line voltage in either polarity and turn on its drive in the same polarity simultaneously for a predetermined amount of time A to replenish the power supplies of the units on the line. The information is measured during time B by the control unit 12. The peak to peak voltage at time B represents the level of voltage at the replying unit.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A communication system usable with a plurality of spaced apart devices comprising:

a control element; and a bidirectional communications link couplable to one or more of the devices wherein said control element includes driver circuitry for reversibly applying a selected electrical potential across said link thereby applying constant amplitude outgoing pulses having first and second widths to said link, and wherein one or more replying devices includes circuitry for reversibly apply a second selected electrical potential across said link thereby applying substantially constant amplitude incoming pulses having third or fourth widths to said bidirectional communication link.

2. A system as in claim 1 wherein said control element and devices include circuitry for modulating said electrical potential with an information sequence.

3. A system as in claim 1 wherein said control element includes circuitry for supplying electrical energy to the one or more devices while at least one device is replying to said control element.

4. A system as in claim 1 wherein at least one of the devices and said control element each include receiver circuitry for detecting said reversibly applied electrical potential.

5. A system as in claim 1 wherein at least one of the devices is an ambient condition detector.

6. A system as in claim 1 wherein at least one of the devices includes rectifier circuitry for rectifying said reversibly applied electrical potential thereby providing a local electrical source for energizing at least the respective device.

7. A system as in claim 5 wherein the ambient condition detector is capable of responding to said reversibly applied electrical potential by coupling an indicium of an adjacent ambient condition to said link and wherein said element includes indicium detecting circuitry.

8. A system as in claim 7 wherein said indicium includes a digital representation of the ambient condition.

9. A system as in claim 1 wherein said incoming pulses, having third or fourth widths all have the same duty cycle.

10. A monitoring system comprising:

a control element;

a bidirectional communications link coupled to said control element wherein said control element includes driver circuitry for reversibly apply a selected electrical potential across said link; and a plurality of monitoring devices coupled to said link wherein at least some of said devices include full-wave rectification circuitry capable of rectifying said reversibly applied electrical potential; and wherein one or more of said devices each includes circuitry for applying digital, symmetrical voltage pulses having first and second widths to said bidirectional communication link wherein said pulses have the same duty cycle.

11. A system as in claim 10 wherein at least some of said devices include an ambient condition detector.

12. A method of bidirectional communication between a control element and one or more displaced devices comprising:

providing a source having a predetermined electrical potential;

reversing the electrical potential as a function of time thereby generating a modulated pulse sequence with a constant amplitude on the order of twice the predetermined potential;

transmitting the modulated pulse sequence to the displaced devices; and wherein one or more displaced devices each includes circuitry for producing a local potential having a local amplitude at the respective device and wherein the respective device communicates with the control element by generating a balanced, width modulated, constant amplitude, pulse sequence wherein the constant amplitude has a value on the order of twice the local amplitude.

13. A method as in claim 12 wherein in the generating step, the pulses of the pulse sequence all have the same duty cycle.

14. A method as in claim 13 wherein the duty cycle is on the order of fifty percent.

15. A method as in claim 12 which includes, in the reversing step, pulse width modulating the pulse sequence.

16. A method as in claim 12 which includes:

supplying electrical energy to power the devices via the modulated pulse sequence.

17. A method as in claim 12 which includes:

detecting the modulated pulse sequence in at least one of the devices.

18. A method as in claim 12 which includes detecting an ambient condition adjacent to at least one of the devices.

19. A method as in claim 12 including supplying electrical energy to the one or more devices while the devices are replying to the transmitted pulse sequence.

* * * * *